US007051990B2

(12) United States Patent
Springett et al.

(10) Patent No.: US 7,051,990 B2
(45) Date of Patent: May 30, 2006

(54) BLOWOUT PREVENTER AND MOVABLE BONNET SUPPORT

(75) Inventors: Frank Benjamin Springett, Houston, TX (US); Eric T. Ensley, Houston, TX (US); James D. Brugman, Spring, TX (US)

(73) Assignee: Varco I/P, Inc., Houston, TX (US)

( * ) Notice: Subject to any disclaimer, the term of this patent is extended or adjusted under 35 U.S.C. 154(b) by 61 days.

(21) Appl. No.: 10/883,564

(22) Filed: Jul. 1, 2004

(65) Prior Publication Data

US 2006/0000992 A1 Jan. 5, 2006

(51) Int. Cl.
*E21B 33/06* (2006.01)

(52) U.S. Cl. ..... 251/1.1

(58) Field of Classification Search ..... 251/1.1–1.3
See application file for complete search history.

(56) References Cited

U.S. PATENT DOCUMENTS

| | | | | |
|---|---|---|---|---|
| 4,253,638 | A | 3/1981 | Troxell, Jr. | 251/1 |
| 4,502,534 | A | 3/1985 | Roche et al. | 166/84 |
| 4,519,577 | A | 5/1985 | Jones | 251/62 |
| 4,558,842 | A | 12/1985 | Peil et al. | 251/1.3 |
| 4,582,293 | A | 4/1986 | Jones | 251/1.3 |
| 5,199,683 | A | 4/1993 | Le | 251/1.3 |
| 5,255,890 | A | 10/1993 | Morrill | 251/1.3 |
| 5,400,857 | A | 3/1995 | Whitby et al. | 166/297 |
| 5,505,426 | A | 4/1996 | Whitby et al. | 251/1.3 |
| 5,575,452 | A | 11/1996 | Whitby et al. | 251/1.3 |
| 5,588,491 | A | 12/1996 | Brugman et al. | 166/383 |
| 5,662,171 | A | 9/1997 | Brugman et al. | 166/383 |
| 5,735,502 | A | 4/1998 | Levett et al. | 251/1.3 |
| 5,897,094 | A | 4/1999 | Brugman et al. | 251/1.3 |
| 6,374,925 | B1 | 4/2002 | Elkins et al. | 175/25 |
| 6,510,897 | B1 | 1/2003 | Hemphill | 166/373 |
| 6,554,247 | B1 | 4/2003 | Berckenhoff et al. | 251/1.3 |
| 2003/0085040 | A1 | 5/2003 | Hemphill et al. | 166/377 |
| 2004/0021269 | A1 | 2/2004 | Gaudette et al. | 277/325 |
| 2004/0084644 | A1 | 5/2004 | Wiedemann | 251/1.3 |
| 2004/0222393 | A1 | 11/2004 | Kinder | 251/1.3 |

*Primary Examiner*—J. Casimer Jacyna
(74) *Attorney, Agent, or Firm*—Guy McClung

(57) ABSTRACT

A blowout preventer which, in certain aspects, has a main body with a main top, a main bottom, and a main bore therethrough from the main top to the main bottom, at least one bonnet releasably secured to the main body, the at least one bonnet containing movable ram apparatus, and side mount apparatus including at least one side mount secured exteriorly to the main body, the side mount for selectively supporting the at least one bonnet; and, in certain aspects, one or more rollers rotatably connected to the bonnet for facilitating movement of the bonnet on the side mount.

18 Claims, 5 Drawing Sheets

BLOWOUT PREVENTER AND MOVABLE BONNET SUPPORT

BACKGROUND OF THE INVENTION

1. Field of the Invention

This present invention is directed to blowout preventers, to bonnets for them, to supports for such bonnets, and, in certain particular aspects, to pivotal bonnet supports, and methods of their use.

2. Description of Related Art

The prior art discloses a wide variety of blowout preventers and blowout preventer bonnets. Typically, a blowout preventer is used in oil and gas well operations to seal a wellbore. Fluids or gas in a formation, through which a wellbore extends exert increasing pressure with increasing formation depth. This pressure can affect the wellbore and equipment associated with the wellbore. Drilling fluid density can be adjusted to balance a formation's fluid's pressure and/or pump pressure can be increased at a surface of the well to pump fluid at a desired pressure to balance pressure.

If formation pressure is encountered that is higher than the pressure maintained in the wellbore, sometimes referred to as a "kick," this pressure can move uphole and damage equipment at the surface causing a "blowout." A blowout can produce severe damage, personal injury, and death.

Blowout preventers are used at the surface (or on a sea floor) to immediately and automatically control kicks and prevent blowouts until other procedures can be employed to deal with the well. The prior art includes both annular blowout preventers and ram-type blowout preventers.

Typical annular blowout preventers have selectively actuatable annular elastomer members which encompass pipe and/or tools and seal off a wellbore. Typical ram-type blowout preventers have a body and at least two oppositely disposed bonnets secured to the body which, in certain prior art systems, are movably secured with movable bars or with hinges and bolts so that the bonnet is movable for access and maintenance. Certain prior art bonnets contain a piston actuated ram which is either a pipe ram (to contact, engage, and encompass pipe and/or tools to seal a wellbore) or shear rams (to contact and physically shear a pipe or tool in a wellbore). Rams are usually positioned opposite each other on either side of a main body and can seal against each other at a center of the main body over a center of a wellbore.

High pressure elastomer seal elements used on blowout preventer rams are regularly inspected and maintained. Such seals can be subject to high pressures and to chemical reaction with drilling fluids which can damage the seals. Often rams are inspected or changed out. Prior art systems include a variety of movable bonnets for accessing rams and seals.

U.S. Pat. Nos. 5,897,094 and 5,975,484, co-owned with the present invention, disclose an improved blowout preventer door connection that includes connector bars for securing bonnets to a blowout preventer.

U.S. Pat. Nos. 6,510,897 and 6,554,247 and U.S. patent applications Ser. Nos. 10/322,038 filed Dec. 17, 2002 and 10/424,698 filed Apr. 28, 2003 disclose rotational mounts for blowout preventer bonnets.

In certain typical ram-type blowout preventers hydraulically actuated cylinders with one or more pistons interconnected to respective rams via a shaft move the rams to shear pipe and sealing a bore (in a shear ram blowout preventer) or move pipe rams for sealing around pipe (in a pipe ram blowout preventer). Certain typical ram actuators disposed in a bonnet have one or more pistons and cylinders connected in a hydraulic circuit with an hydraulic fluid source that provides fluid under pressure to move the piston(s) within the cylinder.

Significant forces are applied to shear a pipe. In certain prior art systems a booster piston and cylinder add force to a primary operating piston and cylinder and the combined forces are applied to rams that shear pipe and seal off a bore. The force required for shearing a pipe is much greater than the force needed to seal an open bore after the pipe has been sheared. If the total ram force used to shear the pipe is applied to the seals on the ram, the seals can be damaged. In certain prior art systems the operating piston force on the seals is reduced after the rams have sheared a pipe; but the hydraulic pressure on such operating pistons can remain at the same high level during both the shearing and sealing operations. Blowout preventers are disclosed in many U.S. Patents, including, but not limited to, U.S. Pat. Nos. 3,946,806; 4,043,389; 4,313,496; 4,132,267, 4,558,842; 4,969,390; 4,492,359; 4,504,037; 2,752,119; 3,272,222; 3,744,749; 4,253,638; 4,523,639; 5,025,708; 5,056,418; 5,400,857; 5,575,452; 5,653,418; 5,655,745; and 5,918,851.

There has long been a need, recognized by the present inventors for a blowout preventer with a bonnet which is movable and stable during movement and which provides easy access to rams within the blowout preventer.

There has long been a need, recognized by the present inventors for apparatus for moving a bonnet which requires a minimum of space and for a blowout preventer with such apparatus that has a minimal footprint.

SUMMARY OF THE PRESENT INVENTION

In one aspect, the present invention discloses a blowout preventer with a bonnet movable on a support connected to a side of a blowout preventer.

In one aspect a blowout preventer according to the present invention has a side mount adjacent to a ram- and actuator-containing bonnet and the bonnet has one, two (or more spaced-apart rollers that move on spaced-apart surfaces of the side mount. In certain aspects the rollers are grooved and the grooves receive a corresponding part of an edge of the side mount. In certain aspects the side mount is a contoured side mount with one portion at an angle to the other and with an intermediate curved portion between the two portions.

In certain aspects such a blowout preventer also includes an interior groove on the side mount. One, two or more rollers rotatably mounted on the bonnet are positioned for movement within the interior groove to enhance stability of the bonnet as it moves in the side mount.

Optionally one or more shock absorbing members may be used between the bonnet and the side mount and, in one particular aspect, one or more yieldably urging members (e.g., but not limited to springs or belleville washers) are interposed between a mount for the rollers that move in the interior groove and a main body of the bonnet.

In certain aspects the side mount is a contoured side mount fashioned and configured with an end portion normal to a (or at an angle to a) main body of the side mount and a curved part between the end portion and the main body. An upper and/or a lower rolling surface of the side mount extend continuously along the entire side mount length so that a bonnet being moved away from the main body of a blowout preventer can be moved to a position at an angle to the main body so that a ram, parts, and/or an actuator within the bonnet can be accessed and/or replaced without completely separating the bonnet from the main body. In one particular aspect stable mounting of the bonnet on the side mount is achieved using two (or more) spaced-apart rollers.

It is, therefore, an object of at least certain preferred embodiments of the present invention to provide new, useful, unique, efficient, nonobvious blowout preventers and methods of their use.

It is, therefore, an object of at least certain preferred embodiments of the present invention to provide new, useful, unique, efficient, nonobvious movable bonnet apparatus for blowout preventers and blowout preventers with such apparatus;

Such bonnet apparatus including a side mount secured to a main body so that a bonnet can be pivotally moved apart from the main body without complete separation therefrom;

Such a blowout preventer and side mount apparatus in which one or more bonnet rollers roll on corresponding spaced-apart surfaces of the side mount;

Such a blowout preventer side mount apparatus and bonnet apparatus including at least one inner roller that moves in an interior side mount groove;

Such a blowout preventer with at least one such bonnet roller (in one aspect two) and at least one inner roller (in one aspect two) which co-act to hold the bonnet in a stable position while it moves; and Such apparatus including shock absorbing apparatus.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

DESCRIPTION OF THE DRAWINGS

A more particular description of embodiments of the invention may be had by references to the embodiments which are shown in the drawings which form a part of + this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
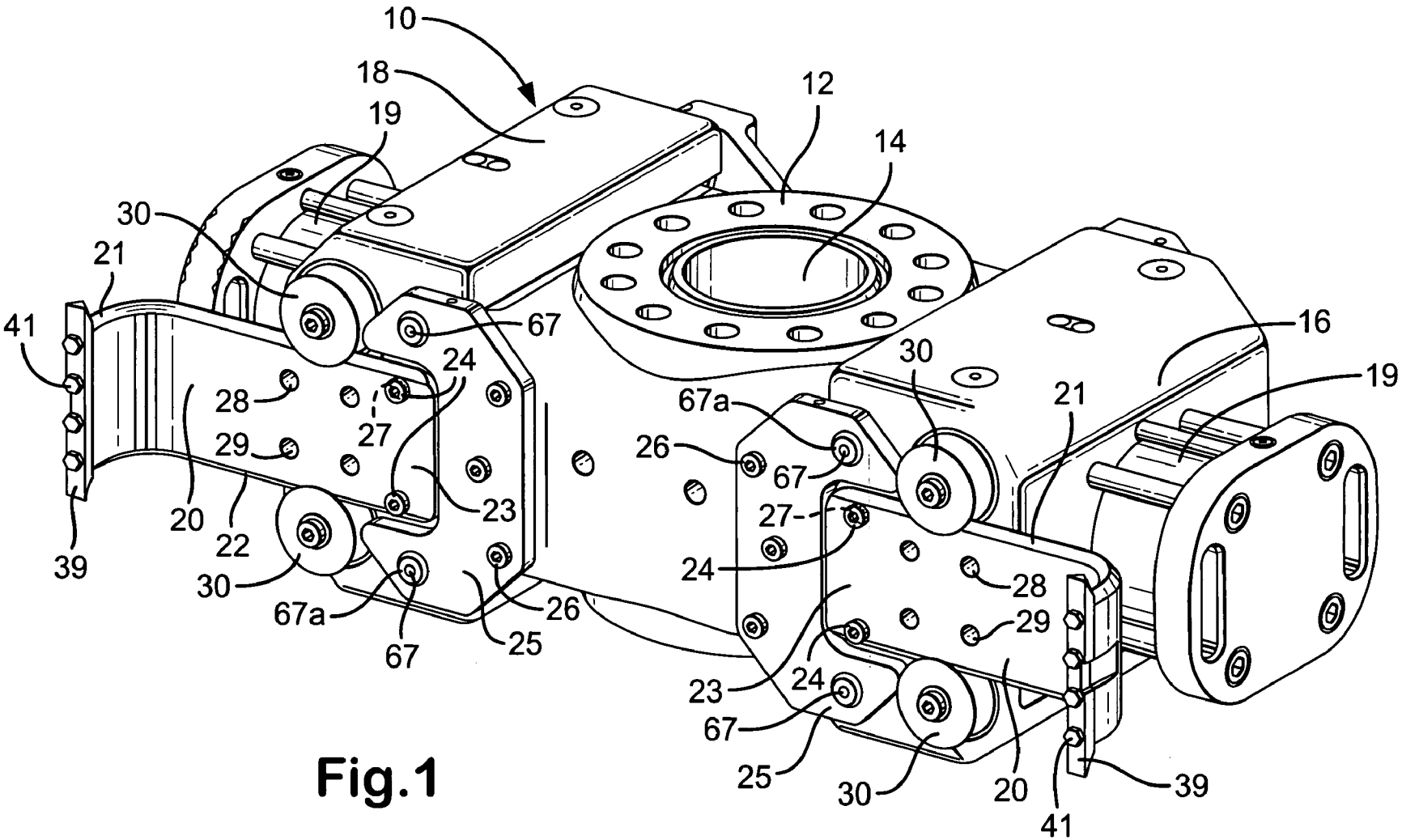
FIG. 1 is a perspective view of a blowout preventer according to the present invention.

FIG. 1 shows a blowout preventer 10 according to the present invention. The blowout preventer 10 has a main body 12 with a main bore 14 therethrough. Bonnets 16 and 18 are diametrically opposed to each other across the main body 12 and each has ram apparatus (not shown in FIG. 1) and ram actuating apparatus 19. Each bonnet 16, 18 is secured to the main body 12 with lock rods 67. Secured to a side of the main body 12 are contoured side mounts 20. Each bonnet 16, 18 can be released from the main body 12 by removing rods 67 which extend through corresponding holes 67*a* in plates 25 and corresponding recesses 18*a* respectively in the bonnet 18 and corresponding recesses, not shown, in the main body 12 and in the bonnet 16. Once freed, each bonnet can be moved along a corresponding side mount 20 and then pivot away from the main body 12, permitting access to the bonnet's contents. Optionally, each bonnet can be disconnected from the body 12.

Figure 2:
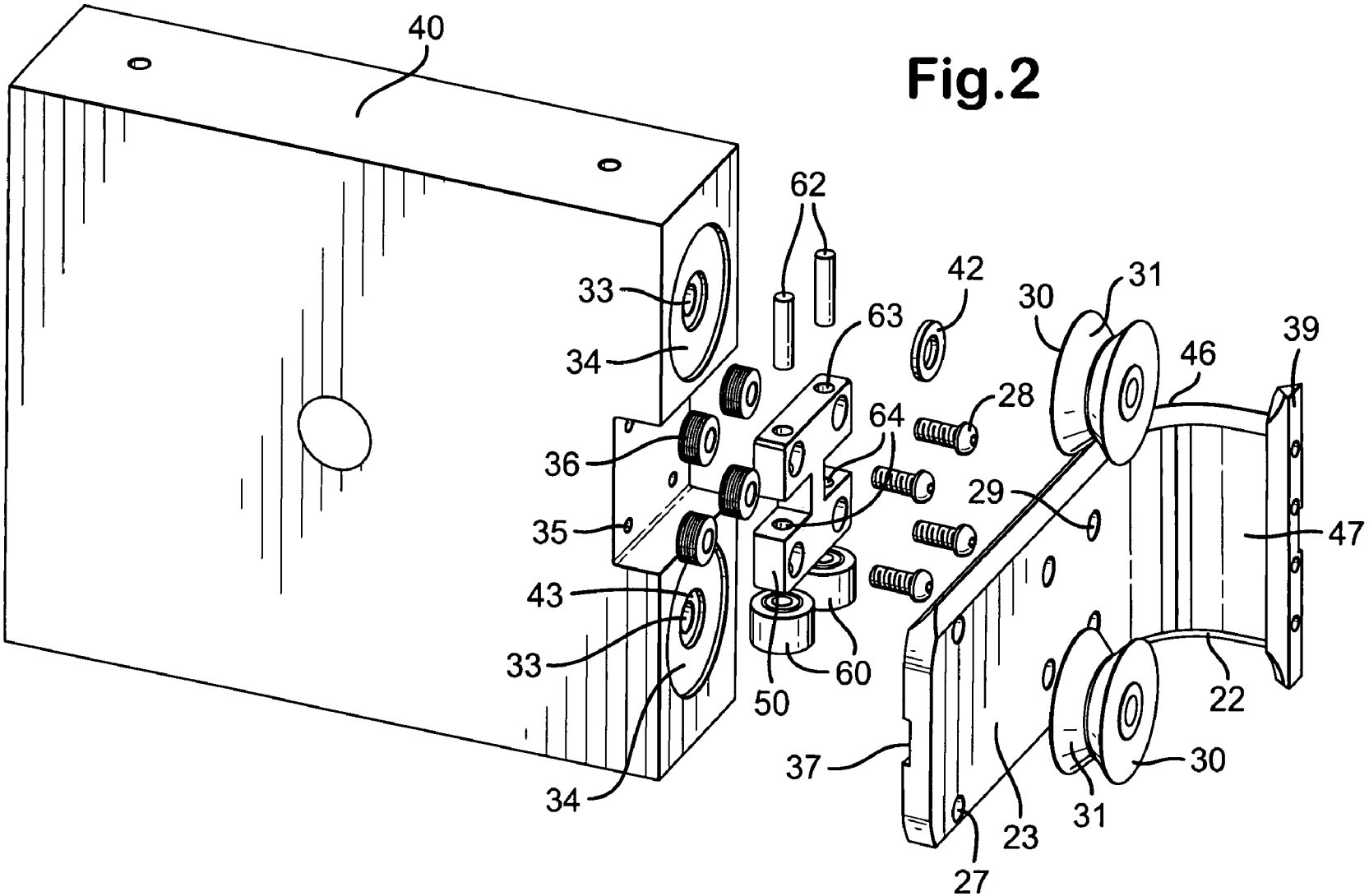
FIG. 2 is a perspective view of part of the blowout preventer of FIG. 1.

The contoured side mounts 20, as shown in FIG. 2, have an upper edge 21 and a lower edge 22 which, optionally, is a tapered edge as shown. It is within the scope of the present invention for these surfaces to be as wide as a main body 23 of the contoured side mounts 20 and for rollers moving therealong to have a correspondingly-sized groove; or, as shown in FIG. 2, these surfaces are shaped and the rollers 30 have a groove 31 corresponding to this shape. Optionally, the edges 21, 22 are flat and the rollers 30 have flat outer rims.

The rollers 30 rotate on shafts 32 which extend into corresponding holes 33 in a bonnet body 40. Optionally, spacers 42 may be used around the shafts 32 and are, in one aspect, sized for receipt within corresponding recesses 43 of the bonnet body 40. The rollers 30 may include roller bearings. Optional recesses 34 accommodate a side face of the rollers 30. Bolts 24 through holes 27 secure the contoured side mounts 20 to the main body 12. Bolts 26 secure the plates 25 to the main body 12. Bolts 28 extending through holes 29 in the body 23 extend through a mount 50 into holes 35 to releasably secure the mount 50 to the bonnet body 40. Optional shock absorbing apparatus is interposed between the mount 50 and the bonnet body 40 [e.g. stacks of belleville spring washers 36 (or any other spring, springy, and/or energy-absorbing, shock-absorbing structure, device or apparatus) encircle the bolts 28].

Optional rollers 60 are rotatably mounted on shafts 62 which extend through holes 63 and 64 in the mount 50. The rollers 60 are sized and located for receipt within a groove 37 in the interior of the contoured side mounts 20. Optionally either the rollers are non-rotating and/or pads or bars are substituted for the rollers. The rollers 60 inhibit binding of the rollers 30. Optionally a single roller 60 (or other member, rotatable or not projecting into the groove 37) is used. A stop member 39 secured with bolts 41 to the body 23 prevents the rollers 30 from disengaging from the body 23. By removing the stop member 39 and disconnecting the bonnet from the main body 12, the bonnet can be removed from the blowout preventer 10. A notch 39*a* in the stop member 39 accommodate the rollers 60.

Figure 2A:
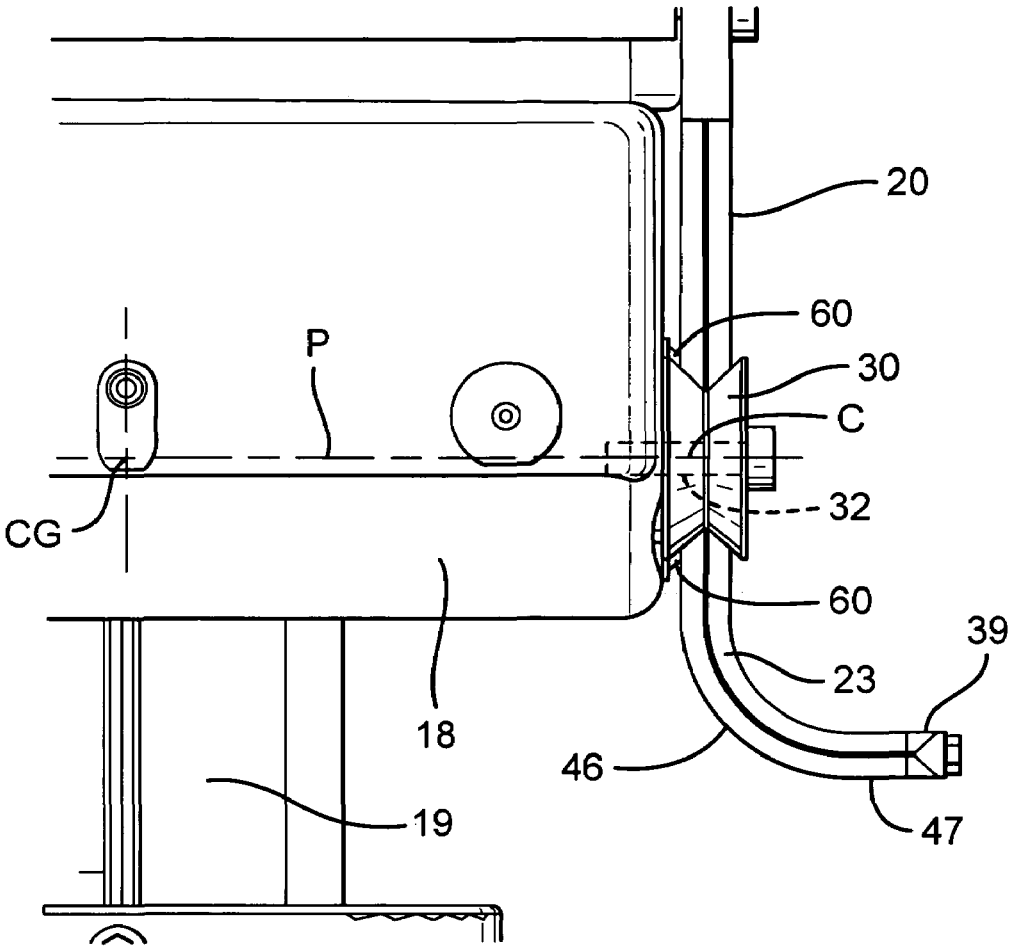
FIG. 2A is a top perspective view of the part of FIG. 2.
Figure 2B:
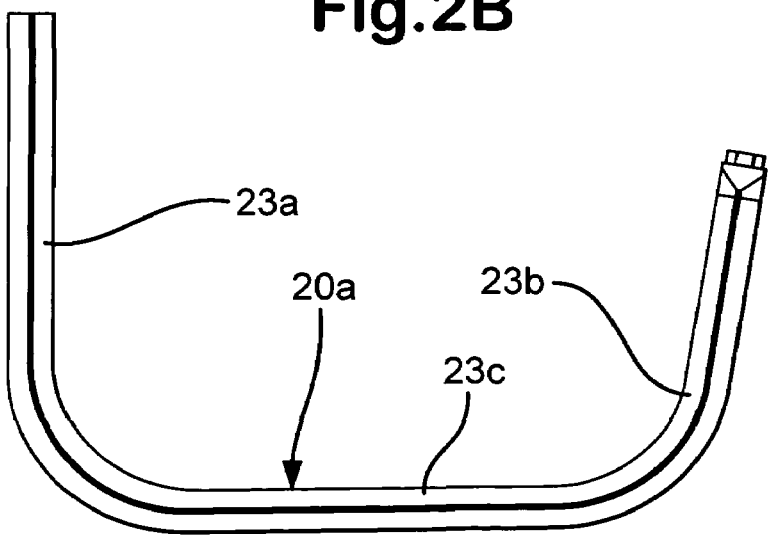
FIG. 2B is a top view of a side mount according to the present invention.

FIG. 2A is a top view showing the relative location of a roller 30 to the rollers 60. Such a "four point" mounting with rollers 60 held in the groove 37 and portions of the edges 21, 22 held within the grooves 31 provides enhanced stability as a bonnet moves on a contoured side mount. A bend 46 in the body 23 leads to an optional end portion 47 thereof which is at an angle (angle shown is about 90°) to the remainder of the body 23. It is within the scope of this invention for this angle to be any desired angle and, in one aspect to have two portions 23 which are, in one aspect parallel to each other [see FIG. 2B, mount 20*a* with portions 23*a*, 23*b* and intermediate portion 23*c*, with portion 23*b*, optionally, at an angle greater than ninety degrees to the portion 23*c* (as may be any such portion on any embodiment herein)]. The bend 46 is sized and configured so that grooved rollers can move on its edges permitting a bonnet to move from a main body of a side mount to an end portion. In one embodiment the center of gravity CG of the bonnet is lined up with the center C of the rollers 30 for enhanced balance and stability; i.e., the center of gravity of the a bonnet is coplanar (in a plane P, FIG. 2A) with the centers of the rollers 30.

Figure 3A:
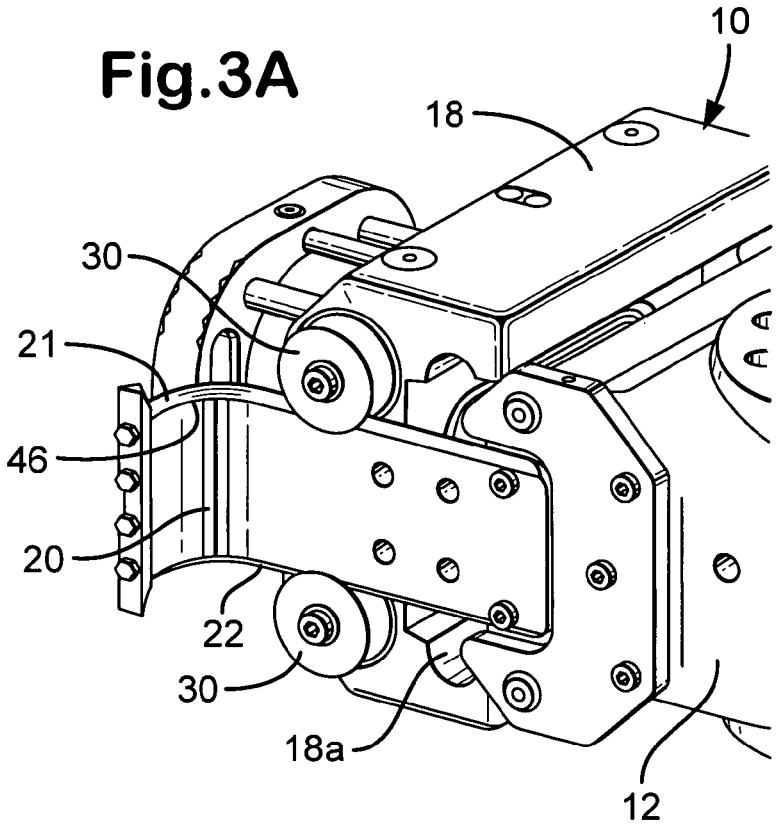
FIGS. 3A–3D are perspective views showing operation of bonnet movement apparatus of the blowout preventer of FIG. 1.
Figure 3B:
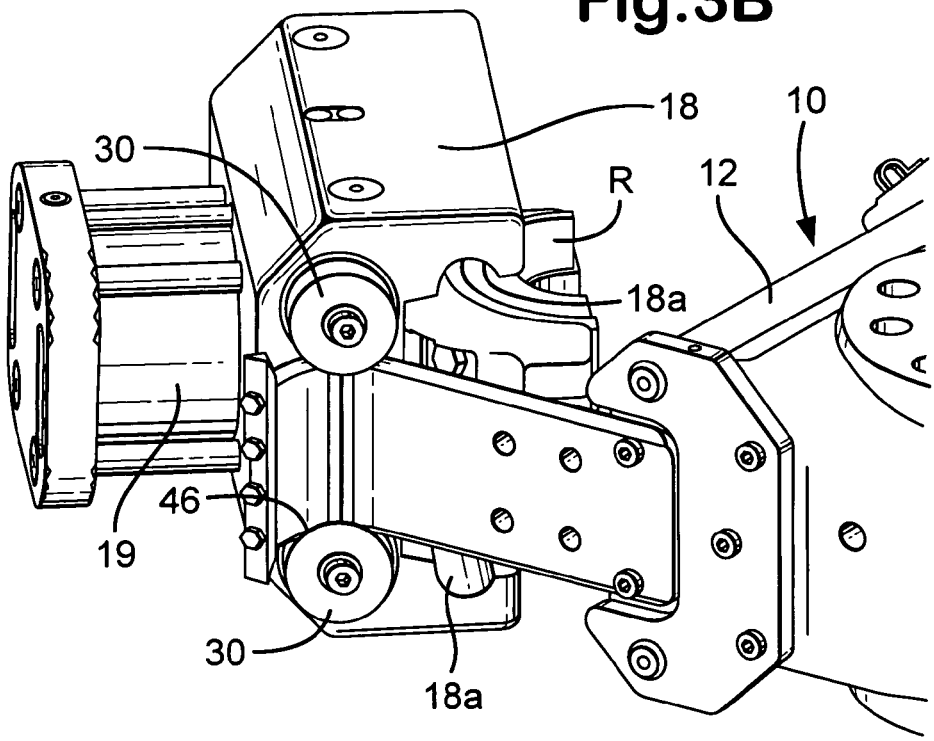
Figure 3C:
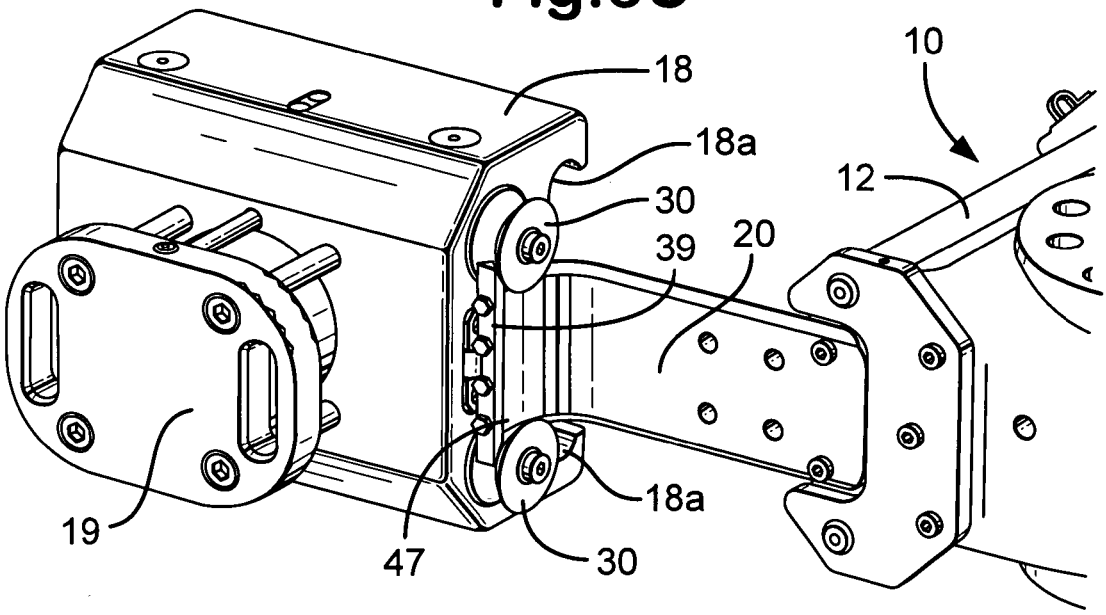

FIGS. 3A–3C show steps in the operation of the bonnet support and movement apparatus of the blowout preventer 10.

Figure 3D:
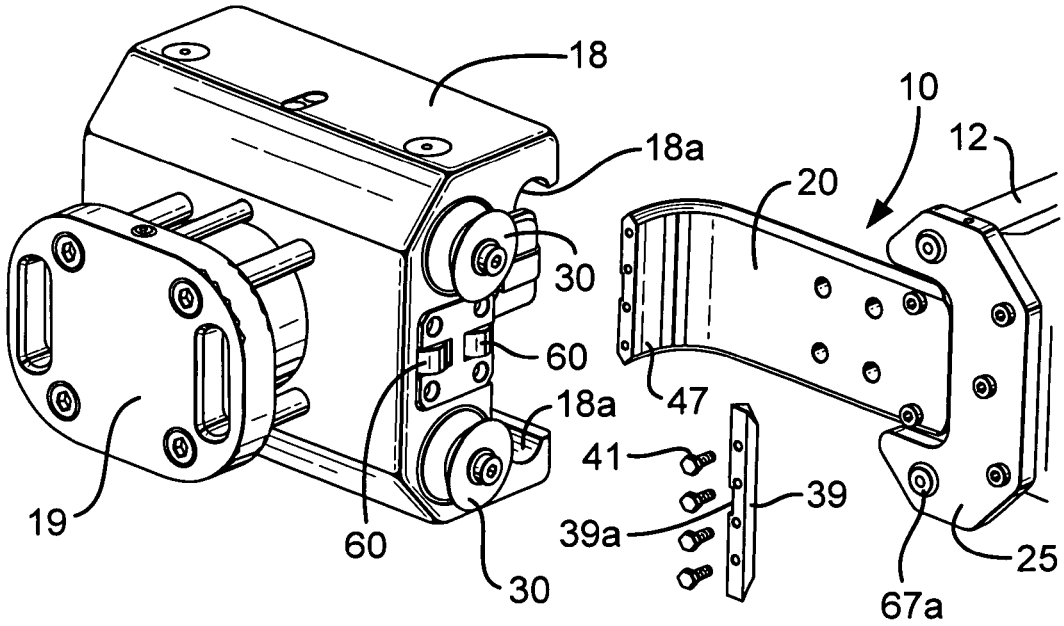

As shown in FIG. 3A, the bonnet 18 has been released from the main body 12 and the rollers 30 have moved on and along their corresponding edges 21, 22 of the contoured side mount 20. The rollers 30 are approaching bend 46 of the contoured side mount 20. As shown in FIG. 3B the rollers 30 are moving on the bend 46 and the bonnet 18 is tilting away from the main body 12. The contoured side mounts 20 are dimensioned so that the bonnet 18 and its contents (ram, ram actuator, etc.) can tilt away from the main body 12 without the bonnet contents hitting or being stopped by part of the main body 12. A ram apparatus R is now accessible. As shown in FIG. 3C the rollers 30 have moved onto the end 47 of the body 23 and the stop member 39 has stopped the movement of the bonnet 18. The bonnet 18 is now substantially normal to the main body 12 and its contents can be accessed and/or removed and replaced. As shown in FIG. 3D, the stop member 39 has been removed from the side mount 20 and the bonnet 18 has been removed from the side mount 20.

In one aspect the end portion 47 is deleted and the body 23 is of sufficient length to permit access to rams, etc. within the bonnet.

The present invention, therefore, provides in some, but not in necessarily all, embodiments a blowout preventer including a main body with a main top, a main bottom, and a main bore therethrough from the main top to the main bottom, at least one bonnet secured to the main body, the at least one bonnet containing apparatus of the blowout preventer, and side mount apparatus including at least one side mount secured exteriorly-to the main body, the at least one side mount for selectively supporting the at least one bonnet.

Such an apparatus may have one or some, in any possible combination, of the following: the at least one side mount having a side mount body with opposed top and bottom edges, and the at least one bonnet having at least one bonnet roller rotatably mounted thereto, the at least one bonnet roller is a first roller, the first roller positioned for movement along an edge of the at least one side mount; wherein the at least one bonnet roller further is a second roller, the second roller positioned for movement along an edge of the at least one side mount opposite the edge along which the first roller is movable; wherein the or each bonnet roller has a roller groove therein and the top and bottom edges of the side mount are shaped to correspond to said roller groove so that part of one of said edges is disposed in said roller groove; wherein said at least one side mount has a mount body and an end portion, the end portion spaced apart from the main body with a curved bend between the end portion and the main body, the main body movable onto the end portion; wherein the end portion is at an angle to the mount body; wherein said angle is about ninety degrees; wherein at said angle the movable ram apparatus is removable from within the at least one bonnet; wherein the at least one bonnet includes a first bonnet on a first side of the main body and a second bonnet on a second side of the main body, the first bonnet opposed to the second bonnet, and wherein the at least one side mount is a first side mount for supporting the first bonnet and a second side mount for supporting the second bonnet; wherein the side mount apparatus has an interior groove and the bonnet has at least one groove roller rotatably mounted thereto and positioned for receipt within said interior groove and for movement therein; wherein said at least one groove roller is two spaced-apart groove rollers; wherein, as viewed from above, the at least one bonnet roller is disposed between the two spaced-apart groove rollers; wherein the bonnet has a center of gravity and centers of the bonnet rollers are coplanar with said center of gravity; the at least one side mount having a side mount body with opposed top and bottom edges, the at least one bonnet having opposed bonnet rollers rotatably mounted thereto, the opposed bonnet rollers including a first roller and a second roller, the first roller positioned for movement along the top edge of the at least one side mount and the second roller positioned for movement along the bottom edge of the at least one side mount, wherein the opposed bonnet rollers each have a roller groove therein and the top edge and bottom edge of the side mount are shaped to correspond to said roller grooves so that a part of one of said edges is disposed in each of said roller grooves, wherein the side mount apparatus has an interior groove and the bonnet has at least one groove roller rotatably mounted thereto and positioned for receipt within said interior groove and for movement therein, wherein said at least one groove roller is two spaced-apart groove rollers, and said two spaced-apart groove rollers are spaced-apart from a line through centers of the two bonnet rollers; wherein the at least one bonnet roller is rotatably secured to a mount, the mount secured to the bonnet, and shock absorbing apparatus is disposed between the mount and the bonnet; and/or a stop member removably secured at an end of the side mount to prevent the bonnet from moving off the at least one side mount.

The present invention, therefore, provides in some, but not in necessarily all, embodiments a side mount for a blowout preventer, the blowout preventer having a main body, and a bonnet releasably connected to the main body, the side mount including a mount body releasably securable to the main body of the blowout preventer, the mount body having a main portion and an end portion at an angle to the main portion, the bonnet movable on the main portion and on the end portion, and a stop member secured to the end portion to prevent the bonnet from moving off the body.

The present invention, therefore, provides in some, but not in necessarily all, embodiments a bonnet for a blowout preventer, the bonnet including a bonnet body, and roller apparatus secured to an exterior of the bonnet body for moving the bonnet body on a mount connected to the blowout preventer.

The present invention, therefore, provides in some, but not in necessarily all, embodiments a method for moving a bonnet of a blowout preventer, the method including releasing a bonnet from a main body of a blowout preventer, the blowout preventer like any, according to the present invention with at least one side mount, and rolling the bonnet on the at least one side mount away from the main body of the blowout preventer; and, in certain aspects, such a method wherein the blowout preventer has a stop member releasably secured at an end of the at least one side mount for preventing the at least one bonnet from moving off the at least one side mount, the method further including releasing the stop member from the at least one side mount, and removing the at least one bonnet from the at least one side mount; and, in certain aspects, such a method wherein a ram block and/or other ram apparatus is accessed in and/or removed from the bonnet.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A blowout preventer comprising a main body with a main top, a main bottom, and a main bore therethrough from the main top to the main bottom, at least one bonnet secured to the main body, the at least one bonnet containing apparatus of the blowout preventer, and side mount apparatus including at least one side mount secured exteriorly to the main body, the at least one side mount for selectively supporting the at least one bonnet, wherein said at least one side mount has a mount body and an end portion, the end portion spaced apart from the main body with a curved bend between the end portion and the main body, the main body movable onto the end portion, and wherein the end portion is at an angle to the mount body.

2. The blowout preventer of claim 1 wherein said angle is about ninety degrees.

3. The blowout preventer of claim 1 wherein at said angle the movable ram apparatus is removable from within the at least one bonnet.

4. A blowout preventer comprising a main body with a main top, a main bottom, and a main bore therethrough from the main top to the main bottom, at least one bonnet secured to the main body, the at least one bonnet containing apparatus of the blowout preventer, and side mount apparatus including at least one side mount secured exteriorly to the main body, the at least one side mount for selectively supporting the at least one bonnet, wherein the side mount apparatus has an interior groove and the bonnet has at least one groove roller rotatably mounted thereto and positioned for receipt within said interior groove and for movement therein, wherein said at feast one groove roller is two spaced-apart groove rollers, and wherein, as viewed from above, the at least one bonnet roller is disposed between the two spaced-apart groove rollers.

5. A blowout preventer comprising a main body with a main top, a main bottom, a main bore therethrough from the main top to the main bottom, at least one bonnet secured to the main body, the at least one bonnet containing apparatus of the blowout preventer, side mount apparatus including at least one side mount secured exteriorly to the main body, each of the at least one side mount for selectively supporting the at least one bonnet, each of the at least one side mount having a top edge and a bottom edge, the top edge above the bottom edge, each of the at least one side mount having a side mount body with opposed top and bottom edges, each of the at least one bonnet having at least one top bonnet roller rotatably mounted thereto, the at least one top bonnet roller comprising a first roller, the first roller positioned for movement along the top edge of each of the at least one side mount, each of the at least one bonnet having at least one bottom roller, the at least one bottom bonnet roller comprising a second roller, the second roller positioned for movement along the bottom edge of each of the at least one side mount.

6. The blowout preventer of claim 5 wherein the or each bonnet roller has a roller groove therein and the top and bottom edges of the side mount are shaped to correspond to said roller groove so that part of one of said edges is disposed in said roller groove.

7. The blowout preventer of claim 5 wherein said at least one side mount has a mount body and an end portion, the end portion spaced apart from the main body with a curved bend between the end portion and the main body, the main body movable onto the end portion.

8. The blowout preventer of claim 7 wherein the end portion is at an angle to the mount body.

9. The blowout preventer of claim 8 wherein said angle is about ninety degrees.

10. The blowout preventer of claim 8 wherein at said angle the movable ram apparatus is removable from within the at least one bonnet.

11. The blowout preventer of claim 5 wherein the at least one bonnet includes a first bonnet on a first side of the main body and a second bonnet on a second side of the main body, the first bonnet opposed to the second bonnet, and wherein the at least one side mount is a first side mount for supporting the first bonnet and a second side mount for supporting the second bonnet.

12. The blowout preventer of claim 5 wherein the side mount apparatus has an interior groove and the bonnet has at least one groove roller rotatably mounted thereto and positioned for receipt within said interior groove and for movement therein.

13. The blowout preventer of claim 12 wherein said at least one groove roller is two spaced-apart groove rollers.

14. The blowout preventer of claim 13 wherein, as viewed from above, the at least one bonnet roller is disposed between the two spaced-apart groove rollers.

15. The blowout preventer of claim 5 wherein the bonnet has a center of gravity and centers of the bonnet rollers are coplanar with said center of gravity.

16. The blowout preventer of claim 5 wherein the side mount apparatus has an interior groove and the bonnet has at least one groove roller rotatably mounted thereto and positioned for receipt within said interior groove and for movement therein, wherein said at least one groove roller is two spaced-apart groove rollers, and said two spaced-apart groove rollers are spaced-apart from a line through centers of the two bonnet rollers.

17. The blowout preventer of claim 5 wherein at least one bonnet roller is rotatably secured to a mount, the mount secured to the bonnet, and shock absorbing apparatus Is disposed between the mount and the bonnet.

18. The blowout preventer of claim 5 further comprising a stop member removably secured at an end of the side mount to prevent the bonnet from moving off the at least one side mount.

* * * * *